US012259177B2

(12) United States Patent
Kang et al.

(10) Patent No.: US 12,259,177 B2
(45) Date of Patent: Mar. 25, 2025

(54) REFRIGERATOR

(71) Applicant: SAMSUNG ELECTRONICS CO., LTD., Suwon-si (KR)

(72) Inventors: Yonghyun Kang, Suwon-si (KR); Joongho Kim, Suwon-si (KR); Jeongman Nam, Suwon-si (KR); Hyoseok Noh, Suwon-si (KR); Sungcheul Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 142 days.

(21) Appl. No.: 17/988,492

(22) Filed: Nov. 16, 2022

(65) Prior Publication Data

US 2023/0235945 A1 Jul. 27, 2023

Related U.S. Application Data

(63) Continuation of application No. PCT/KR2022/017323, filed on Nov. 7, 2022.

(30) Foreign Application Priority Data

Jan. 27, 2022 (KR) ..... 10-2022-0012686

(51) Int. Cl.
*F25D 23/02* (2006.01)
*F25D 23/06* (2006.01)

(52) U.S. Cl.
CPC ..... *F25D 23/028* (2013.01); *F25D 23/061* (2013.01); *F25D 23/063* (2013.01); *F25D 2323/021* (2013.01)

(58) Field of Classification Search
CPC .... F25D 23/028; F25D 23/061; F25D 23/063; F25D 2323/021

(Continued)

(56) References Cited

U.S. PATENT DOCUMENTS 9,157,676 B2 * 10/2015 Lee ..... F25D 23/12
9,163,870 B2 * 10/2015 Jeon ..... F25D 23/02

(Continued)

FOREIGN PATENT DOCUMENTS

CN 212902196 U 4/2021
JP 6334186 5/2018

(Continued)

OTHER PUBLICATIONS

International Search Report dated Feb. 14, 2023 in International Patent Application No. PCT/KR2022/017323 (3 pages; 3 pages English translation).

(Continued)

*Primary Examiner* — Daniel J Troy
*Assistant Examiner* — Timothy M Ayres
(74) *Attorney, Agent, or Firm* — STAAS & HALSEY LLP

(57) ABSTRACT

A refrigerator includes an inner case, an outer case, and an insulating material. The refrigerator includes a first door, a second door where the second door is to open and close at least another portion of a storage compartment, a rotating bar rotatable with respect to the first door or the second door so that the rotating bar covers a gap between the first door and the second door while the first door and the second door are closed; and a rotation guide coupleable to the inner case to guide the rotating bar while the rotating bar is being rotated according to opening and closing of the first door or the second door. The inner case is formed to cover a front member of the rotation guide so that the front member of the rotation guide is unexposed to a front side of the inner case.

15 Claims, 11 Drawing Sheets

(58) Field of Classification Search
USPC ..... 312/405
See application file for complete search history.

(56) References Cited

U.S. PATENT DOCUMENTS

| | | | | |
|---|---|---|---|---|
| 9,188,382 | B2 * | 11/2015 | Kim | A47B 71/00 |
| 9,845,628 | B2 * | 12/2017 | Jung | E05F 1/10 |
| 9,874,391 | B2 * | 1/2018 | Jung | F25D 23/025 |
| 9,995,528 | B1 * | 6/2018 | Ebrom | H04N 23/64 |
| 10,429,121 | B2 | 10/2019 | Yoon et al. | |
| 10,458,698 | B2 * | 10/2019 | Ham | F25D 23/087 |
| 10,544,982 | B2 * | 1/2020 | Kim | F25D 23/028 |
| 10,775,095 | B2 * | 9/2020 | Gwon | F25D 25/025 |
| 10,808,982 | B2 | 10/2020 | Hanson | |
| 10,852,053 | B2 | 12/2020 | Seo et al. | |
| 10,907,880 | B2 * | 2/2021 | Avhale | F25D 21/04 |
| 10,907,885 | B2 | 2/2021 | Jung et al. | |
| 10,907,890 | B2 | 2/2021 | Deka | |
| 2012/0137722 | A1 | 6/2012 | Kim | |
| 2017/0191738 | A1 * | 7/2017 | Jung | E05C 19/16 |
| 2017/0234606 | A1 * | 8/2017 | Dubina | F25D 23/028 312/404 |
| 2018/0328650 | A1 * | 11/2018 | Okazaki | F25D 23/028 |
| 2019/0170427 | A1 | 6/2019 | Baum et al. | |
| 2022/0333845 | A1 * | 10/2022 | Xia | E05D 7/084 |

FOREIGN PATENT DOCUMENTS

| | | | |
|---|---|---|---|
| JP | 6857227 | B2 | 4/2021 |
| KR | 10-2011-0032898 | | 3/2011 |
| KR | 10-1052784 | B1 | 7/2011 |
| KR | 10-1522186 | B1 | 5/2015 |
| KR | 10-2016-0062861 | | 6/2016 |
| KR | 10-2017-0027246 | | 3/2017 |
| KR | 10-2018-0080054 | | 7/2018 |
| KR | 10-2243486 | B1 | 4/2021 |
| WO | WO 2019/113408 | A1 | 6/2019 |

OTHER PUBLICATIONS

PCT/ISA/237 dated Feb. 14, 2023 in International Patent Application No. PCT/KR2022/017323 (4 pages).

* cited by examiner

REFRIGERATOR

CROSS-REFERENCE TO RELATED APPLICATION(S)

This application is a continuation application, under 35 U.S.C. § 111 (a), of international application No. PCT/KR2022/017323, filed on Nov. 7, 2022, which claims priority to Korean Patent Application No. 10-2022-0012686, filed on Jan. 27, 2022 in the Korean Intellectual Property Office, the disclosures of which are incorporated by reference herein in their entireties

BACKGROUND

1. Field

The disclosure relates to a refrigerator and more particularly, to a refrigerator including a rotating bar.

2. Description of Related Art

A refrigerator is an appliance that is composed of a main body including a storage compartment, a cold air supply device configured to supply cold air to the storage compartment, and a door configured to open and close the storage compartment, so as to keep food fresh.

Generally, a front surface of the storage compartment is opened to insert and withdraw food and the open front surface of the storage compartment is closed by the door. In response to the door being opened, cold air inside the storage compartment may flow out and warm air outside the storage compartment may flow into the inside of the storage compartment, thereby increasing a temperature of the storage compartment.

The temperature of the storage compartment is required to be maintained within a certain range to keep the food fresh, and if the temperature of the storage compartment rises, there may be a difficulty in keeping the food fresh and an extra energy may be required to low the temperature of the storage compartment to a normal level.

A French Door Refrigerator (hereinafter, FDR refrigerator) may include a rotating bar rotatably coupled to a left door or a right door in order to prevent a leakage of cold air through a gap between the left door and the right door.

A main body of the FDR refrigerator may be provided with a rotation guide guiding a rotation of the rotating bar to allow the rotating bar to be rotated according to opening and closing of the door.

SUMMARY

In accordance with an aspect of the disclosure, a refrigerator includes an inner case forming a storage compartment, an outer case coupleable to an outside of the inner case to form an exterior of the refrigerator, an insulating material arranged between the inner case and the outer case while the outer case is coupled to the inner case, a first door rotatably coupleable to the outer case to open and close at least a portion of the storage compartment, a second door at a side of the first door and rotatably coupleable to the outer case to open and close at least another portion of the storage compartment, a rotating bar configured to be rotated with respect to the first door or the second door so that the rotating bar covers a gap between the first door and the second door while the first door and the second door are closed, and a rotation guide coupleable to the inner case to guide the rotating bar while the rotating bar is being rotated according to opening and closing of the first door or opening and closing of the second door. The inner case is formed to cover a front member of the rotation guide so that the front member of the rotation guide is unexposed to a front side of the inner case.

The inner case may include a flange member forming a front edge of the inner case.

The flange member may include a guide cover having a shape corresponding to a shape of the front member of the rotation guide so that the front member of the rotation guide is unexposed to a front side of the flange member of the inner case.

The inner case may include an upper plate, a lower plate, a left plate, a right plate, and a rear plate which are formed by injection molding.

The upper plate may include an upper plate flange forming at least a portion of the flange member.

The guide cover may be provided on the upper plate flange.

The upper plate flange may be formed as a one-piece without a parting line.

The guide cover may include a first protrusion formed to protrude downward from the upper plate flange, a second protrusion formed to protrude downward from the upper plate flange, the second protrusion being laterally spaced apart from the first protrusion, and a guide opening between the first protrusion and the second protrusion.

The rotation guide may include a guide groove provided to guide a rotation of the rotating bar.

A front end of the guide groove and the guide opening may be provided in a shape corresponding to each other.

The refrigerator may further include a heating pipe between the inner case and the outer case and along the front edge of the inner case, and a heat conduction plate to transfer heat from the heating pipe to the rotation guide while the heat conduction plate is in contact with the heating pipe and the rotation guide.

The upper plate may include a pipe receiving groove at a rear side of the guide cover and provided to receive the heating pipe.

The heat conduction plate may be provided to be in contact with the heating pipe from an outside of the pipe receiving groove.

The heat conduction plate may include a pipe receiving member insertable into the pipe receiving groove to receive the heating pipe and be in contact with heating pipe.

The upper plate may include a guide mounting groove, under the pipe receiving groove and at a rear side of the guide cover, to allow the rotation guide to be inserted into the guide mounting groove.

The heat conduction plate may include a guide contact member mountable to the guide mounting groove, and an extension member formed to extend upwardly from one end of the guide contact member toward the heating pipe.

The guide mounting groove may include a first fastening hole.

The rotation guide may include a second fastening hole corresponding to the first fastening hole.

The heat conduction plate may include an opening provided to correspond to the first fastening hole and formed to be larger than the first fastening hole.

The rotation guide may be coupleable to the guide mounting groove using a fastening member which passes through the second fastening hole and the opening of the heat conduction plate to be fastened to the first fastening hole.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
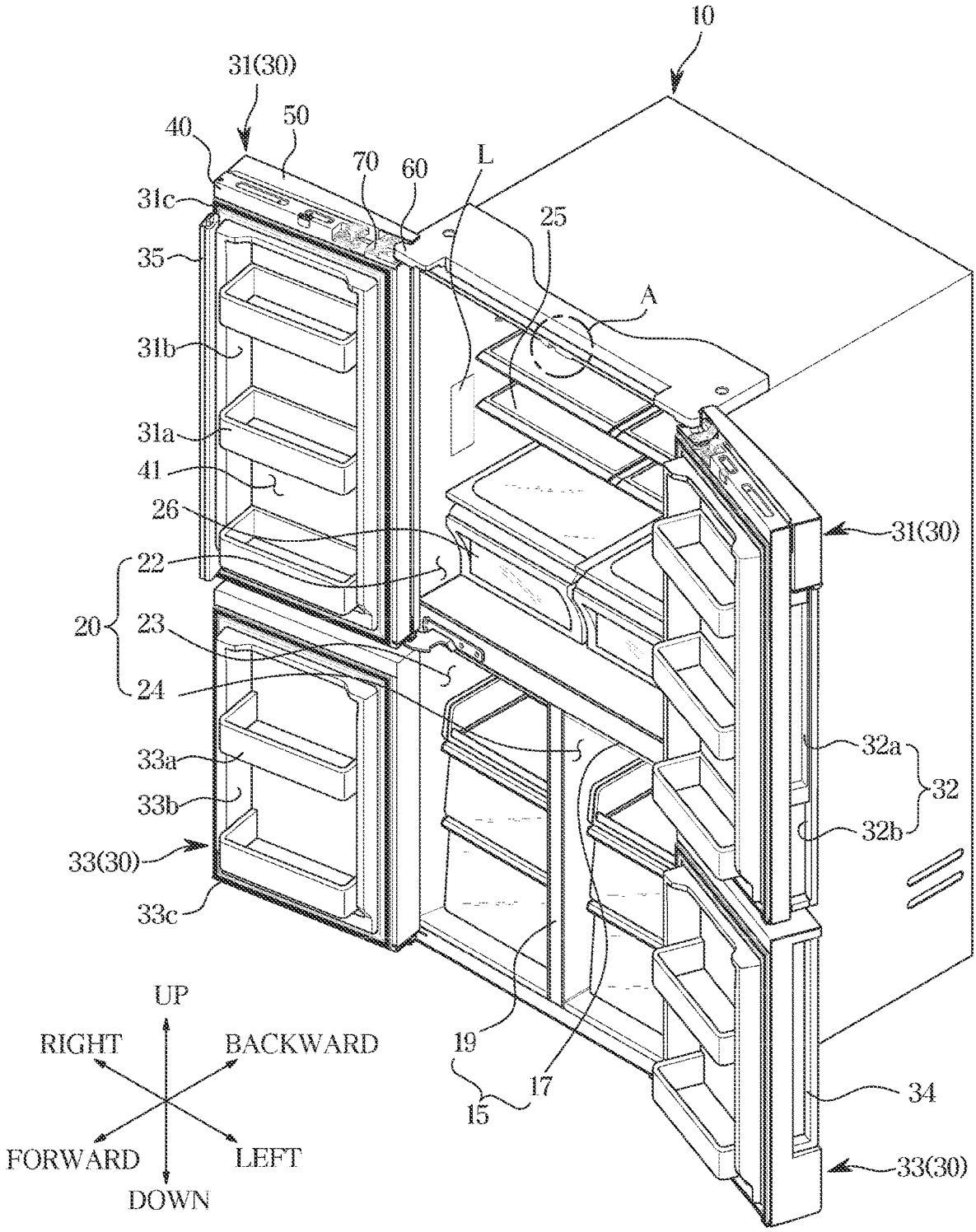
FIG. 1 is a perspective view of a refrigerator according to an embodiment of the disclosure, illustrating a state in which a door is opened.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

It is an aspect of the disclosure to provide a refrigerator with improved appearance quality by preventing a rotation guide from being exposed to a front of an inner case.

It is another aspect of the disclosure to provide a refrigerator with improved appearance quality thereof by including a flange member, without a parting line, of an inner case.

The disclosure will be described more fully hereinafter with reference to the accompanying drawings.

Figure 2:
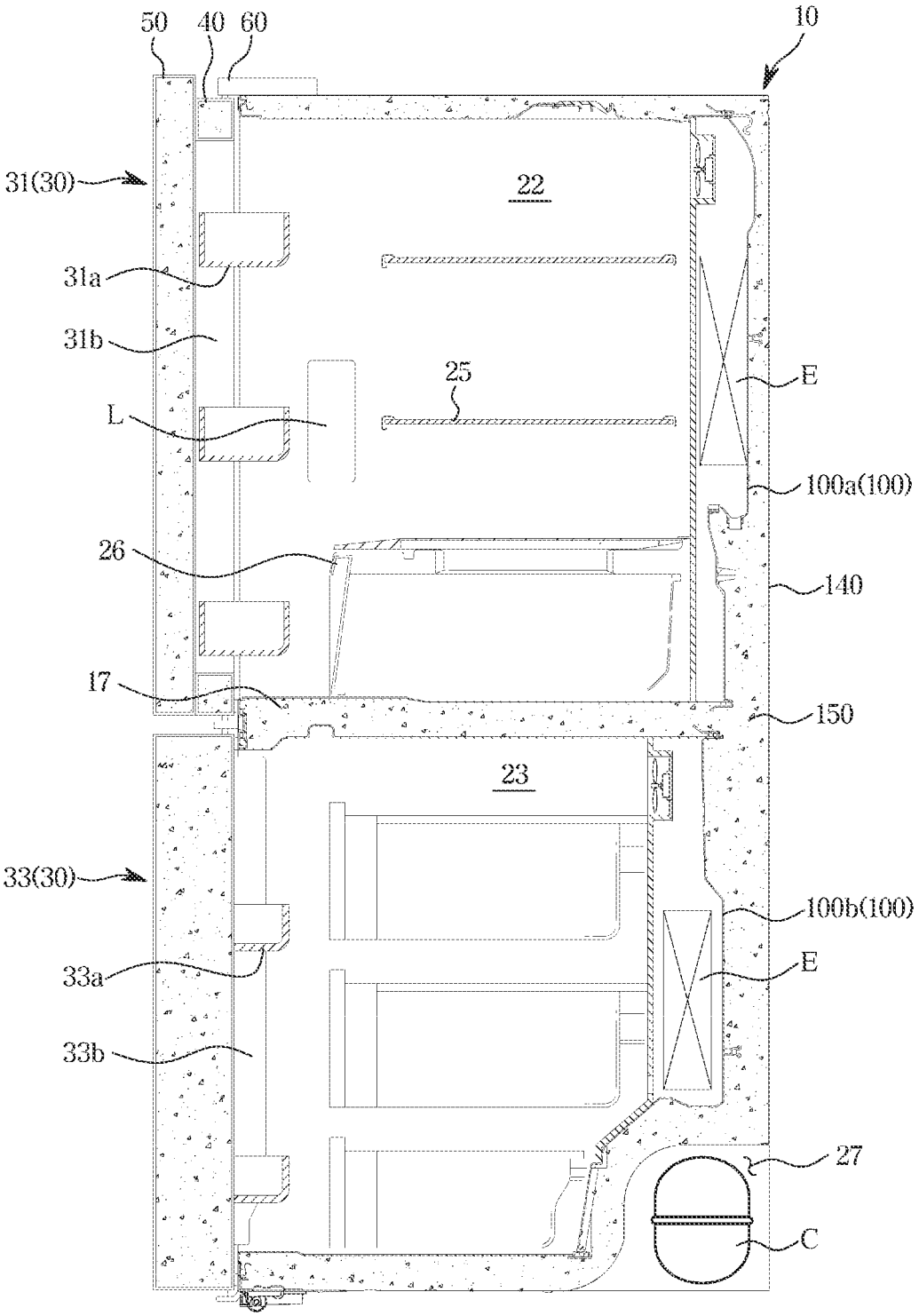
FIG. 2 is a schematic side cross-sectional view of the refrigerator according to an embodiment of the disclosure.

FIG. 1 is a perspective view of a refrigerator according to an embodiment of the disclosure, illustrating a state in which a door is opened. FIG. 2 is a schematic side cross-sectional view of the refrigerator according to an embodiment of the disclosure.

In the description, up, down, left, right, front and rear are defined based on a direction illustrated in FIG. 1.

As illustrated in FIGS. 1 and 2, a refrigerator may include a main body 10, a storage compartment 20 vertically partitioned inside the main body 10, a door 30 configured to open and close the storage compartment 20, and a cold air supply device (not shown) configured to supply cold air to the storage compartment 20.

The main body 10 may include an inner case 100 forming the storage compartment 20, an outer case 140 coupled to an outside of the inner case 100 to form an exterior, and an insulating material 150 foamed between the inner case 100 and the outer case 140 to insulate the storage compartment 20.

A machine room 27, in which a compressor C configured to compress a refrigerant and a condenser (not shown) configured to condense the refrigerant compressed by the compressor C are installed, may be provided at a rear lower portion of the main body 10.

The cold air supply device may include the compressor C configured to compress the refrigerant, the condenser (not shown) configured to condense the refrigerant, an expansion valve (not shown) configured to expand the refrigerant, and an evaporator E configured to evaporate the refrigerant.

The storage compartment 20 may be divided into a plurality by a partition 15, and a plurality of shelves 25 and storage containers 26 may be provided in the storage compartment 20 to store food and the like.

The storage compartment 20 may be divided into a plurality of storage compartments 22, 23, and 24 by the partition 15, and the partition 15 may include a first partition 17 horizontally coupled to the inside of the storage compartment 20 to divide the storage compartment 20 into a first storage compartment 22 and second storage compartments 23 and 24, and a second partition 19 vertically coupled to the inside of the second storage compartments 23 and 24 to divide the second storage compartments 23 and 24 into a first lower storage compartment 23 and a second lower storage compartment 24.

The partition 15 including a T-shape formed by the first partition 17 and the second partition 19 coupled to each other may divide the storage compartment 20 into three spaces. Among the first storage compartment 22 and the second storage compartments 23 and 24 divided by the first partition 17, the first storage compartment 22 may be used as a refrigerating compartment, and the second storage compartments 23 and 24 may be used as a freezing compartment.

All the second storage compartments 23 and 24 may be used as the freezing compartment. Alternatively, the first lower storage compartment 23 may be used as the freezing compartment and the second lower storage compartment 24 may be used as the refrigerating compartment. Alternatively, the first lower storage compartment 23 may be used as the freezing compartment, and the second lower storage compartment 24 may be used as the freezing compartment and the refrigerating compartment.

The division of the storage compartment 20 as described above is an example, and each storage compartment 22, 23, and 24 may be used differently from the above configuration.

The refrigerating compartment 22 and the freezing compartments 23 and 24 may be opened and closed by the door 30 rotatably coupled to the main body 10, respectively.

The door 30 may include a pair of refrigerating compartment doors 31 rotatably coupled to the main body 10 to open and close the refrigerating compartment 22, and a pair of freezing compartment doors 33 rotatably coupled to the main body 10 to open and close the freezing compartments 23 and 24.

The pair of refrigerating compartment doors 31 may be respectively opened and closed through a pair of refrigerating compartment door handles 32 including a first door handle 32*a* or a second door handle 32*b*. The refrigerating compartment 22 may be opened and closed by the pair of refrigerating compartment doors 31, and a rotating bar 35 may be installed on at least one of the pair of refrigerating compartment doors 31 so as to seal a gap between the pair of refrigerating compartment doors 31 in response to closing the refrigerating compartment doors 31. The rotating bar 35 may be rotatably coupled to at least one of the pair of refrigerating compartment doors 31. The rotating bar 35 may be guided by a rotation guide 250 (refer to FIG. 8) formed on the inner case 100, so as to be rotated according to the opening and closing of the refrigerating compartment door 31.

The pair of freezing compartment doors 33 may be respectively opened and closed by a freezing compartment door handle 34. A sliding door may be applied to the door configured to open and close the freezing compartments 23 and 24.

Door shelves 31*a* and 33*a* in which food is stored may be provided on rear surfaces of the pair of refrigerating compartment doors 31 and the pair of freezing compartment doors 33, respectively.

The door shelves 31*a* and 33*a* may respectively include shelf supports 31*b* and 33*b* extending vertically from the doors 31 and 33 to support each of the door shelves 31*a* and 33*a* on left and right sides of each of the door shelves 31*a* and 33*a*. The shelf supports 31*b* and 33*b* may extend from the doors 31 and 33, respectively. The shelf supports 31*b* and 33*b* may be provided as a separate configuration to be detachably installed on each door 31 and 33.

In addition, first gaskets 31*c* and 33*c* may be provided on the rear edge of each door 31 and 33 to seal a gap with the main body 10 in response to the close of the doors 31 and 33. The first gaskets 31*c* and 33*c* may be installed in a loop shape along the edges on the rear surface of each door 31 and 33, and a magnet (not shown) may be included in the first gaskets 31*c* and 33*c*.

The pair of refrigerating compartment doors 31 configured to open and close the refrigerating compartment 22 may be arranged left and right. Hereinafter for convenience of description, only the refrigerating compartment door 31 arranged on the left side of the drawing will be described, and the refrigerating compartment door 31 arranged on the left side of the drawing will be referred to as the refrigerating compartment door 31. However, the refrigerating compartment door 31 described below is not limited to the refrigerating compartment door 31 arranged on the left side of the drawing, but may also be applied to the refrigerating compartment door 31 arranged on the right side of the drawing, and applied to at least one of the pair of freezing compartment doors 33.

The refrigerating compartment door 31 may be provided as a double door including a first door 40 and a second door 50.

The first door 40 may be rotatably connected to the main body 10 by a first hinge 60 so as to open and close the refrigerating compartment 22. The above-described door shelf 31*a*, shelf support 31*b*, and first gasket 31*c* may be provided on the first door 40.

The first door 40 may include an opening 41 that is formed to allow a user to approach the door shelf 31*a* to insert or withdraw food while the first door 40 is closed. The opening 41 may be formed to pass through the first door 40 and may be opened and closed by the second door 50.

The second door 50 may be provided in front of the first door 40 to open and close the opening 41 of the first door 40, and the second door 50 may be rotatable in the same direction as the first door 40. Although the drawing illustrates that the second door 50 is rotatably supported by a second hinge 70 installed on the first door 40 and thus the second door 50 is rotatable with respect to the first door 40, the disclosure is not limited thereto. Alternatively, the second door 50 may be rotatable with respect to the main body 10 because the second hinge 70 is installed on the main body 10.

The second door 50 may include a second gasket (not shown) for maintaining airtightness with the first door 40. The second gasket may be installed in a loop shape along an edge of a rear surface of the second door 50, and a magnet (not shown) may be included therein.

Figure 3:
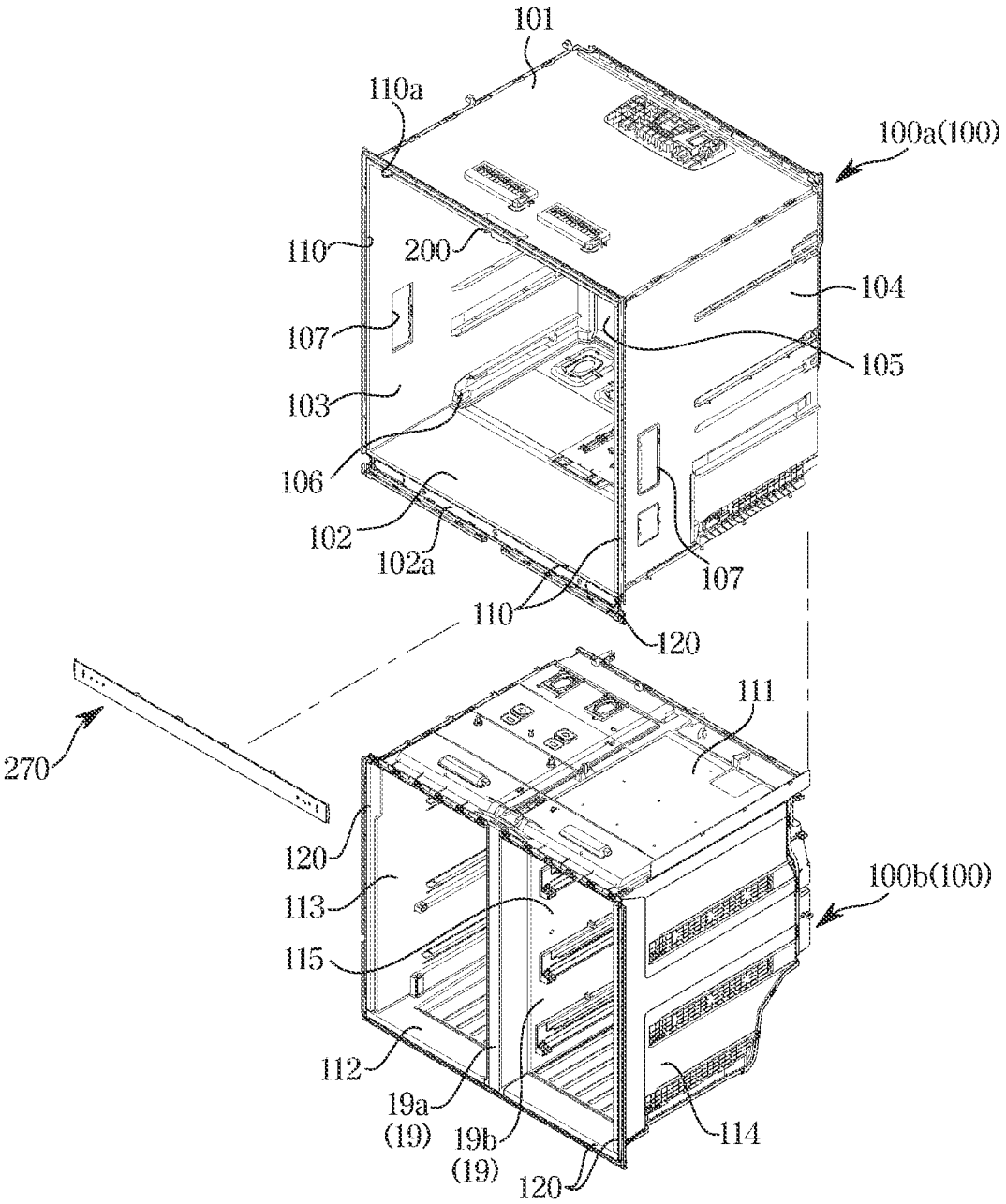
FIG. 3 is a view illustrating a state in which a first inner case and a second inner case are separated from each other in the refrigerator according to an embodiment of the disclosure.
Figure 4:
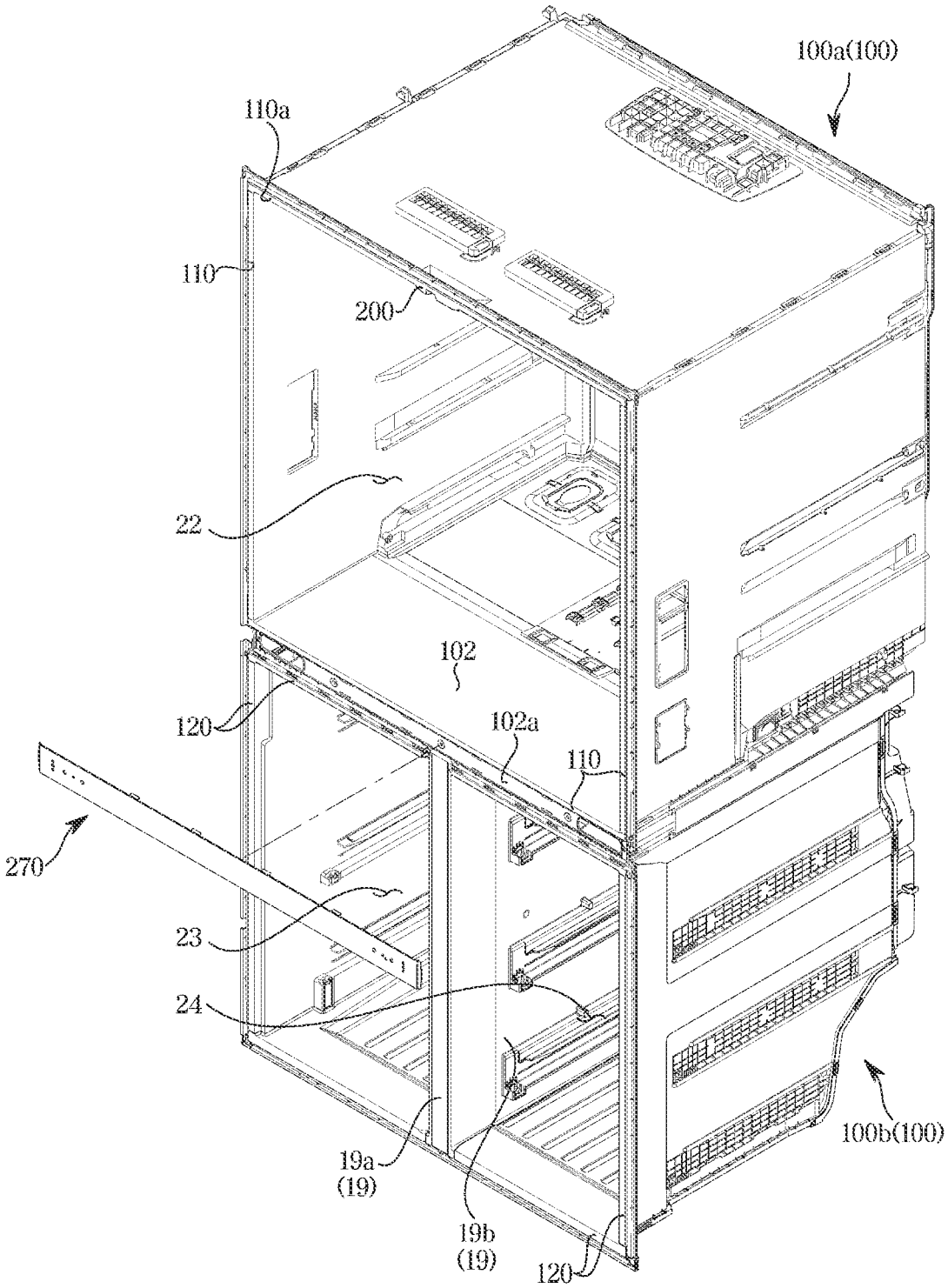
FIG. 4 is a view illustrating a state in which the first inner case and the second inner case are coupled to each other in the refrigerator according to an embodiment of the disclosure.

FIG. 3 is a view illustrating a state in which a first inner case and a second inner case are separated from each other in the refrigerator according to an embodiment of the disclosure. FIG. 4 is a view illustrating a state in which the first inner case and the second inner case are coupled to each other in the refrigerator according to an embodiment of the disclosure.

Referring to FIGS. 3 and 4, the refrigerator according to the disclosure may include a first inner case 100*a* and a second inner case 100*b*. The first inner case 100*a* and the second inner case 100*b* may be provided to be coupled to each other. The first inner case 100*a* and the second inner case 100*b* may be coupled to each other to form the inner case 100.

The first inner case 100*a* and the second inner case 100*b* may be coupled to each other without a separate fastening member such as a screw. The first inner case 100*a* and the second inner case 100*b* may be provided to be inseparable after being coupled to each other.

Figure 5:
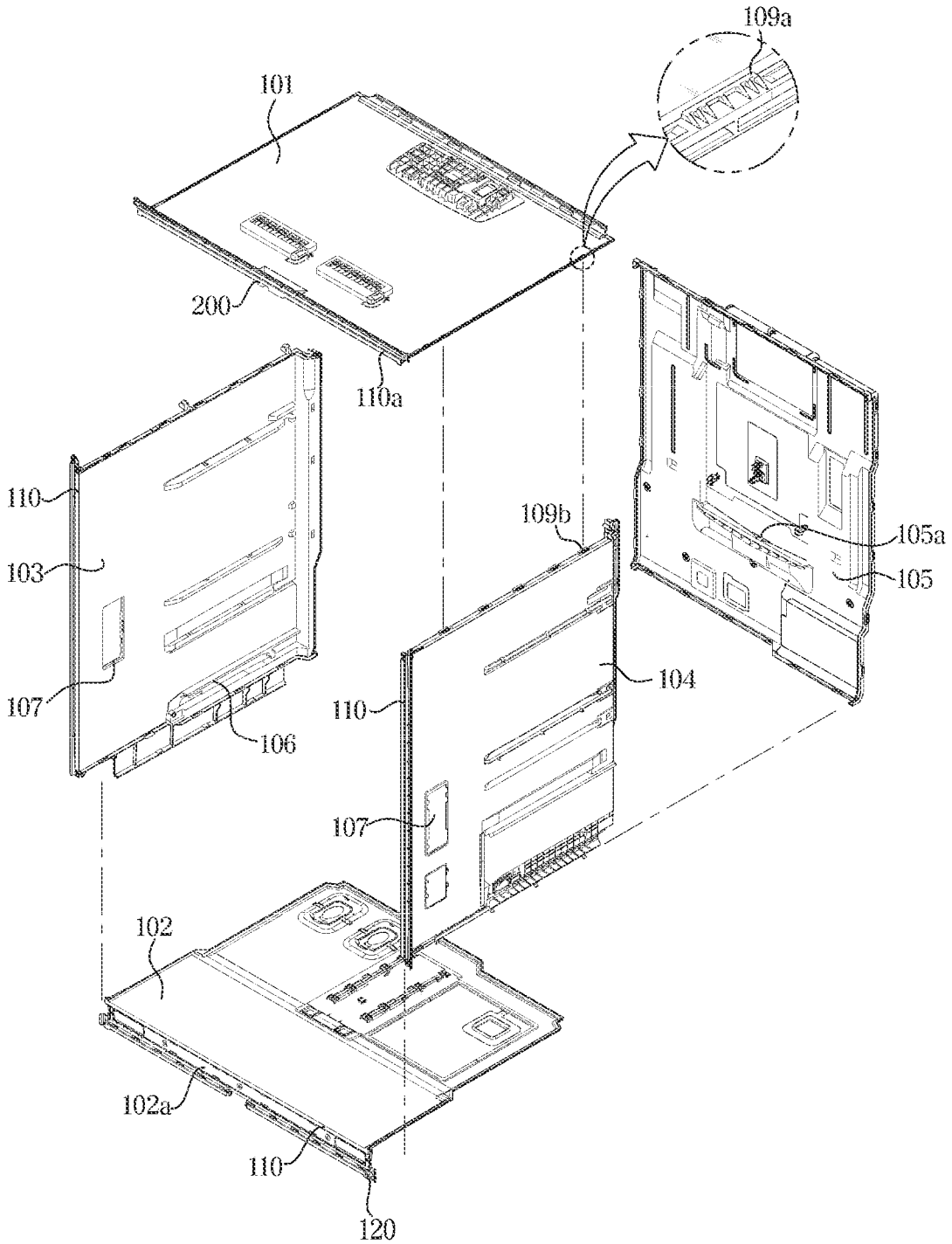
FIG. 5 is a view illustrating a state in which the first inner case is disassembled in the refrigerator according to an embodiment of the disclosure.
Figure 6:
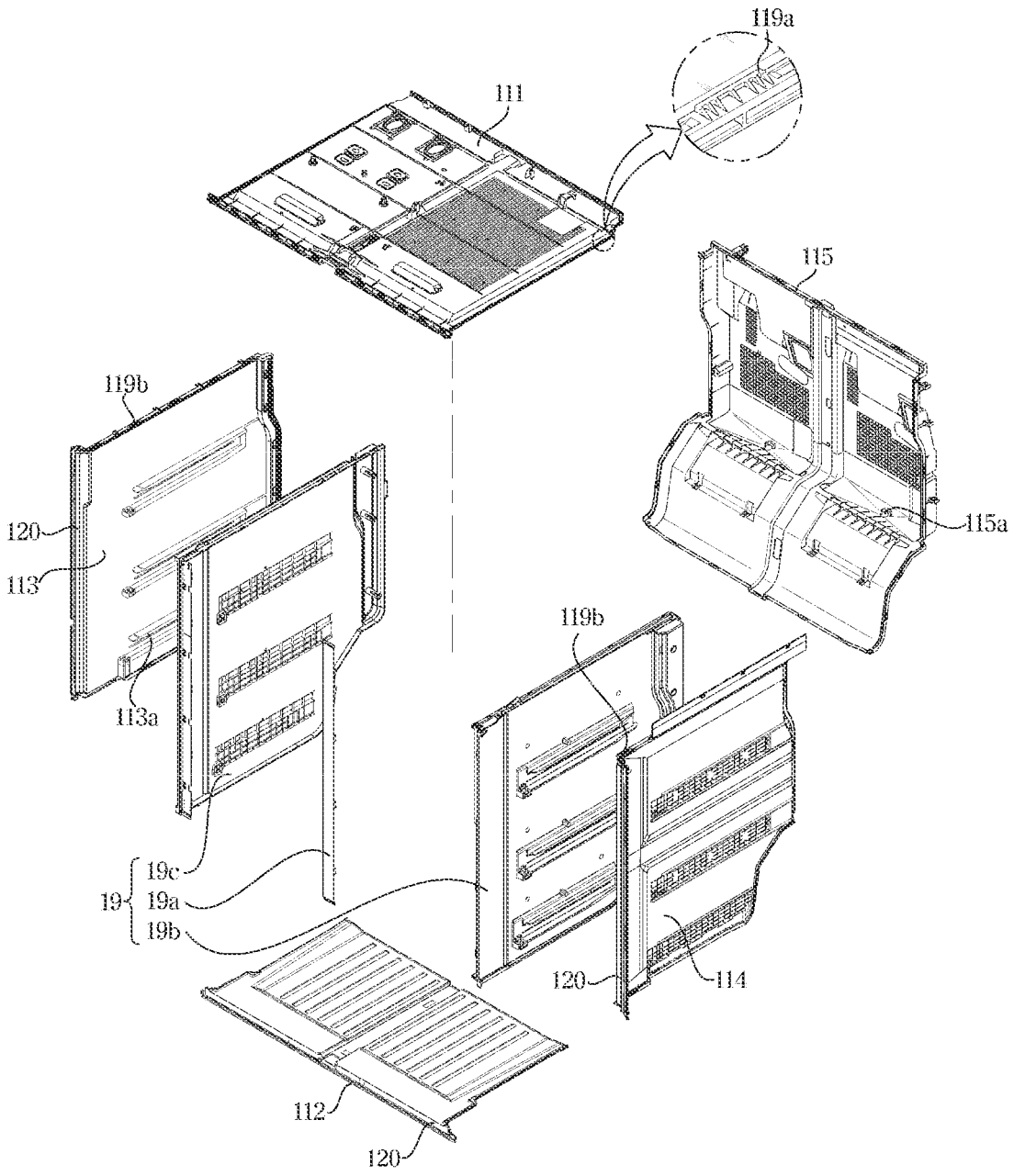
FIG. 6 is a view illustrating a state in which the second inner case is disassembled in the refrigerator according to an embodiment of the disclosure.

FIG. 5 is a view illustrating a state in which the first inner case is disassembled in the refrigerator according to an embodiment of the disclosure. FIG. 6 is a view illustrating a state in which the second inner case is disassembled in the refrigerator according to an embodiment of the disclosure.

Referring to FIGS. 5 and 6, the inner case 100 may include the first inner case 100*a* forming the refrigerating compartment 22 positioned in the upper portion of the inner case 100, and the second inner case 100*b* forming the freezing compartments 23 and 24 positioned below the refrigerating compartment 22. The first inner case 100*a* and the second inner case 100*b* may be coupled by the same coupling structure in which only the shapes are partially different.

Referring FIG. 5, the first inner case 100*a* according to an embodiment may include a plurality of first plates 101, 102, 103, 104, and 105. The first inner case 100*a* may be formed by coupling the plurality of first plates 101, 102, 103, 104, and 105. The plurality of first plates 101, 102, 103, 104, and 105 may be coupled to each other without a separate fastening member. That is, each of the plurality of first plates 101, 102, 103, 104, and 105 may include a coupler integrally formed for mutual coupling thereof.

The plurality of first plates 101, 102, 103, 104, and 105 may be formed of a resin material through an injection molding method. Each of the plurality of first plates 101, 102, 103, 104, and 105 may include four edges. The plurality of first plates 101, 102, 103, 104, and 105 may include a first upper plate 101, a first lower plate 102, a first left plate 103, a first right plate 104, and a first rear plate 105.

The first upper plate 101 may form an upper surface of the first storage compartment 22. The first lower plate 102 may form a lower surface of the first storage compartment 22. The first left plate 103 may form a left surface of the first storage compartment 22. The first right plate 104 may form a right surface of the first storage compartment 22. The first rear plate 105 may form a rear surface of the first storage compartment 22.

A shape of the first upper plate 101, the first lower plate 102, the first left plate 103, the first right plate 104 and the first rear plate 105 is not limited to a flat shape without a curve. Alternatively, the first upper plate 101, the first lower plate 102, the first left plate 103, the first right plate 104 and the first rear plate 105 may include a curve. Therefore, the first upper plate 101, the first lower plate 102, the first left plate 103, the first right plate 104 and the first rear plate 105 may include various shapes as long as forming the upper surface, the lower surface, the left surface, the right surface and the rear surface of the first storage compartment 22.

In addition, unlike the embodiment, at least two or more plates adjacent to each other among the first upper plate 101, the first lower plate 102, the first left plate 103, the first right plate 104, and the first rear plate 105 may be integrally formed with each other.

That is, unlike the embodiment, the first inner case 100*a* may be formed of a number of parts less than the five parts corresponding to the first upper plate 101, the first lower plate 102, the first left plate 103, the first right plate 104, and the first rear plate 105.

For example, the first upper plate 101 and the first right plate 104 may be integrally injection-molded, and the first lower plate 102 and the first left plate 103 may be integrally injection-molded. Alternatively, the first upper plate 101 and the first left plate 103 may be integrally injection-molded, and the first lower plate 102 and the first right plate 104 may be integrally injection-molded.

Even when the first inner case 100*a* is formed of a number of parts less than the five parts corresponding to the first upper plate 101, the first lower plate 102, the first left plate 103, the first right plate 104, and the first rear plate 105, as described above, descriptions described below may be equally applied.

The first inner case 100*a* may include the first upper plate 101, the first lower plate 102, the first left plate 103, the first right plate 104, and the first rear plate 105. The first upper plate 101, the first lower plate 102, the first left plate 103, the first right plate 104, and the first rear plate 105 may be provided to be separated from each other. The first upper plate 101, the first lower plate 102, the first left plate 103, the first right plate 104, and the first rear plate 105 may be injection molded. The first upper plate 101, the first lower plate 102, the first left plate 103, the first right plate 104, and the first rear plate 105 provided to be separated may be assembled to form the first inner case 100*a*. Because the first upper plate 101, the first lower plate 102, the first left plate 103, the first right plate 104, and the first rear plate 105 are injection molded, the first upper plate 101, the first lower plate 102, the first left plate 103, the first right plate 104, and the first rear plate 105 may be molded to have various patterns (not shown) without an additional post-process. Further, the first upper plate 101, the first lower plate 102, the first left plate 103, the first right plate 104, and the first rear plate 105 may be molded to have various colors. That is, the first upper plate 101, the first lower plate 102, the first left plate 103, the first right plate 104, and the first rear plate 105 may have a different pattern or a different color for each purpose of the storage compartment 20. In addition, the first upper plate 101, the first lower plate 102, the first left plate 103, the first right plate 104, and the first rear plate 105 may all have different patterns or different colors. Accordingly, for the user choice in the refrigerator, it is possible to widen a range of selection.

First flange members 110 and 110*a* forming a part of a front flange may be integrally formed on the first upper plate 101, the first lower plate 102, the first left plate 103, and the first right plate 104. The flange members 110 and 110*a* may refer to a flat portion provided along a front edge of the first inner case 100*a*. According to an embodiment, based on the injection molding of the first upper plate 101, the first lower plate 102, the first left plate 103, and the first right plate 104, the first flange members 110 and 110*a* may be integrally formed with the first upper plate 101, the first lower plate 102, the first left plate 103, and the first right plate 104. Hereinafter the first flange member 110*a* of the first upper plate 101 is referred as an upper plate flange 110*a*.

The rotation guide 250 provided to guide a rotation of the rotating bar 35, which is rotatably coupled to the pair of refrigerating compartment doors 31, may be coupled to a lower surface of the first upper plate 101.

A lamp case 107 in which a light emitting diode (LED) (L: refer to FIG. 1) is arranged may be injection-molded integrally with the first left plate 103 and the first right plate 104.

A rail 106, in which the storage container 26 is supported to slidably move, may be injection-molded integrally with the first left plate 103 and the first right plate 104.

The first rear plate 105 is injection molded into a thin film to have competitiveness in material cost, and for this, a plurality of gates (not shown) may be required. The first rear plate 105 may include a drain hole 105*a* provided to drain the condensed water or defrost water falling from the evaporator E.

The first lower plate 102 may include an extension 102*a*. The extension 102*a* may extend downwardly from a front end of the first lower plate 102. The extension 102*a* may cover a front surface of a space formed between the first inner case 100*a* and the second inner case 100*b* in response to the coupling of the first inner case 100*a* and the second inner case 100*b*.

According to an embodiment, the refrigerator may further include a flange plate 270 provided to be coupled to the extension 102*a* to connect the first flange member 110 of the extension 102*a* to a second flange member 120 of the extension 102*a*.

A plurality of assembly hooks 109*a* or a plurality of assembly holes 109*b* for assembly may be formed on the first upper plate 101, the first lower plate 102, the first left plate 103, the first right plate 104, and the first rear plate 105. The first upper plate 101, the first lower plate 102, the first left plate 103, and the first right plate 104 may be assembled to each other through the remaining three edge surfaces, excluding the front, of the four edge surfaces. Accordingly, the plurality of assembly hooks 109*a* or the plurality of assembly holes 109*b* may be formed on the remaining three edge surfaces, excluding the front, of the four edge surfaces of the first upper plate 101, the first lower plate 102, the first left plate 103, and the first right plate 104. Further, the plurality of assembly hooks 109*a* or the plurality of assembly holes 109*b* may be formed on all the four edge surfaces of the first rear plate 105. That is, when the assembly of the first upper plate 101 and the first right plate 104 is described as an example, the plurality of assembly hooks 109*a* may be formed on a right surface of the first upper plate 101, and the plurality of assembly holes 109*b* may be formed on an upper surface of the first right plate 104 assembled to the right surface of the first upper plate 101. Although it is shown in the drawing that the plurality of assembly hooks 109*a* is formed on the right surface of the first upper plate 101 and the plurality of assembly holes 109*b* is formed on the upper surface of the first right plate 104, the plurality of assembly holes 109*b* may be formed on the right surface of the first upper plate 101, and the plurality of assembly hooks 109*a* may formed on the upper surface of the first right plate 104. The first lower plate 102, the plurality of assembly hooks 109*a* may be formed on the lower side of the three edge surfaces, and thus the plurality of assembly hooks 109*a* may not be shown in the drawing.

Referring FIG. 6, the second inner case 100*b* according to an embodiment may include a plurality of second plates 111, 112, 113, 114, and 115. The second inner case 100*b* may be formed by coupling the plurality of second plates 111, 112, 113, 114, and 115. The plurality of second plates 111, 112, 113, 114, and 115 may be coupled to each other without a separate fastening member. That is, each of the plurality of second plates 111, 112, 113, 114, and 115 may include a coupler integrally formed for mutual coupling thereof.

Referring FIG. 6, the second inner case 100*b* according to an embodiment may include a first partition plate 19*b* and a second partition plate 19*c*, which form a second partition 19, and a partition cover 19*a* provide to cover a front portion of the first partition plate 19*b* and the second partition plate 19*c*.

The second partition 19 may partition the second storage compartments 23 and 24 to the left and right by being coupled to the second inner case 100*b*.

The plurality of second plates 111, 112, 113, 114, and 115 may be formed of a resin material through an injection molding method. Each of the plurality of second plates 111, 112, 113, 114, and 115 may include four edges. The plurality of second plates 111, 112, 113, 114, and 115 may include a second upper plate 111, a second lower plate 112, a second left plate 113, a second right plate 114, and a second rear plate 115.

The second upper plate 111 may form an upper surface of the second storage compartments 23 and 24. The second lower plate 112 may form a lower surface of the second storage compartments 23 and 24. The second left plate 113 may form a left surface of the second storage compartments 23 and 24. The second right plate 114 may form a right surface of the second storage compartments 23 and 24. The second rear plate 115 may form a rear surface of the second storage compartments 23 and 24.

A shape of the second upper plate 111, the second lower plate 112, the second left plate 113, the second right plate 104 and the second rear plate 115 is not limited to a flat shape without a curve. Alternatively, the second upper plate 111, the second lower plate 112, the second left plate 113, the second right plate 114 and the second rear plate 115 may include a curve. Therefore, the second upper plate 111, the second lower plate 112, the second left plate 113, the second right plate 104 and the second rear plate 115 may include various shapes as long as forming the upper surface, the lower surface, the left surface, the right surface and the rear surface of the second storage compartments 23 and 24.

In addition, unlike the embodiment, at least two or more plates adjacent to each other among the second upper plate 111, the second lower plate 112, the second left plate 113, the second right plate 114 and the second rear plate 115 may be integrally formed with each other.

That is, unlike the embodiment, the second inner case 100*b* may be formed of a number of parts less than the five parts corresponding to the second upper plate 111, the second lower plate 112, the second left plate 113, the second right plate 114 and the second rear plate 115.

For example, the second upper plate 111 and the second right plate 114 may be integrally injection-molded, and the second lower plate 112 and the second left plate 113 may be integrally injection-molded. Alternatively, the second upper plate 111 and the second left plate 113 may be integrally injection-molded, and the second lower plate 112 and the second right plate 114 may be integrally injection-molded.

Even when the second inner case 100*b* is formed of a number of parts less than the five parts corresponding to the second upper plate 111, the second lower plate 112, the second left plate 113, the second right plate 114 and the second rear plate 115, as described above, descriptions described below may be equally applied.

The second inner case 100*b* may include the second upper plate 111, the second lower plate 112, the second left plate 113, the second right plate 114 and the second rear plate 115, in the same manner as the first inner case 100*a*. The second upper plate 111, the second lower plate 112, the second left plate 113, the second right plate 114 and the second rear plate 115 may be provided to be separated from each other. The second upper plate 111, the second lower plate 112, the second left plate 113, the second right plate 114 and the second rear plate 115 may be injection molded. The second upper plate 111, the second lower plate 112, the second left plate 113, the second right plate 114 and the second rear plate 115 provided to be separated may be assembled to form the second inner case 100*b*. Because the second upper plate 111, the second lower plate 112, the second left plate 113, the second right plate 114 and the second rear plate 115 are injection molded, the second upper plate 111, the second lower plate 112, the second left plate 113, the second right plate 114 and the second rear plate 115 may be molded to have various patterns (not shown) without an additional post-process. Further, the second upper plate 111, the second lower plate 112, the second left plate 113, the second right plate 114 and the second rear plate 115 may be molded to have various colors. That is, the second upper plate 111, the second lower plate 112, the second left plate 113, the second right plate 114 and the second rear plate 115 may have a different pattern or a different color for each purpose of the storage compartment 20. In addition, the second upper plate 111, the second lower plate 112, the second left plate 113, the second right plate 114 and the second rear plate 115 may all have different patterns or different colors. Accordingly, for the user choice in the refrigerator, it is possible to widen a range of selection.

The second flange member 120 forming a part of a front flange may be integrally formed on the second lower plate 112, the second left plate 113, and the second right plate 114. The front flange may refer to a flat portion provided along a front edge of the second inner case 100*b*. According to an embodiment, based on the injection molding of the second lower plate 112, the second left plate 113, and the second right plate 114, the second flange member 120 may be integrally formed with the second lower plate 112, the second left plate 113, and the second right plate 114. According to an embodiment, the second flange member 120 may be not provided in the second upper plate 111. This is because the second flange member 120 is provided in the first lower plate 102.

A rail 113*a* (not shown), in which the storage container is supported to slidably move, may be injection-molded integrally with the second left plate 113 and the second right plate 114.

The second rear plate 115 is injection molded into a thin film to have competitiveness in material cost, and for this, a plurality of gates (not shown) may be required. The second rear plate 115 may include a drain hole 115*a* provided to drain the condensed water or defrost water falling from the evaporator E.

According to an embodiment, a plurality of assembly hooks 119*a* or a plurality of assembly holes 119*b* for assembly may be formed on the second upper plate 111, the second lower plate 112, the second left plate 113, the second right plate 114 and the second rear plate 115. The second upper plate 111, the second lower plate 112, the second left plate 113, and the second right plate 114 may be assembled to each other through the remaining three edge surfaces, excluding the front, of the four edge surfaces. Accordingly, the plurality of assembly hooks 119*a* or the plurality of assembly holes 119*b* may be formed on the remaining three edge surfaces, excluding the front, of the four edge surfaces of the second upper plate 111, the second lower plate 112, the second left plate 113, and the second right plate 114. Further, the plurality of assembly hooks 119*a* or the plurality of assembly holes 119*b* may be formed on all the four edge surfaces of the second rear plate 115. That is, when the assembly of the second upper plate 111 and the second right plate 114 is described as an example, the plurality of assembly hooks 119*a* may be formed on a right surface of the second upper plate 111, and the plurality of assembly holes 119*b* may be formed on an upper surface of the second right plate 114 assembled to the right surface of the second upper plate 111. Although it is shown in the drawing that the plurality of assembly hooks 119*a* is formed on the right surface of the second upper plate 111 and the plurality of assembly holes 119*b* is formed on the upper surface of the second right plate 114, the plurality of assembly holes 119*b* may be formed on the right surface of the second upper plate 111, and the plurality of assembly hooks 119*a* may formed on the upper surface of the second right plate 114. As for the second lower plate 112, the plurality of assembly hooks 119*a* may be formed on the three edge surfaces.

Figure 7:
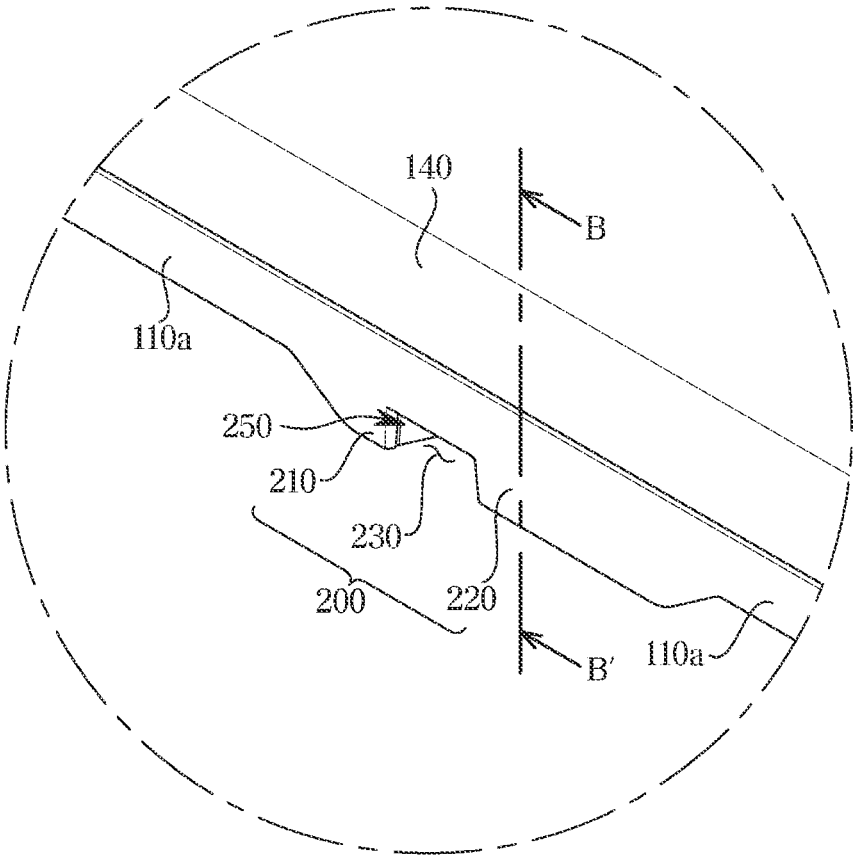
FIG. 7 is an enlarged view of a part A of FIG. 1.
Figure 8:
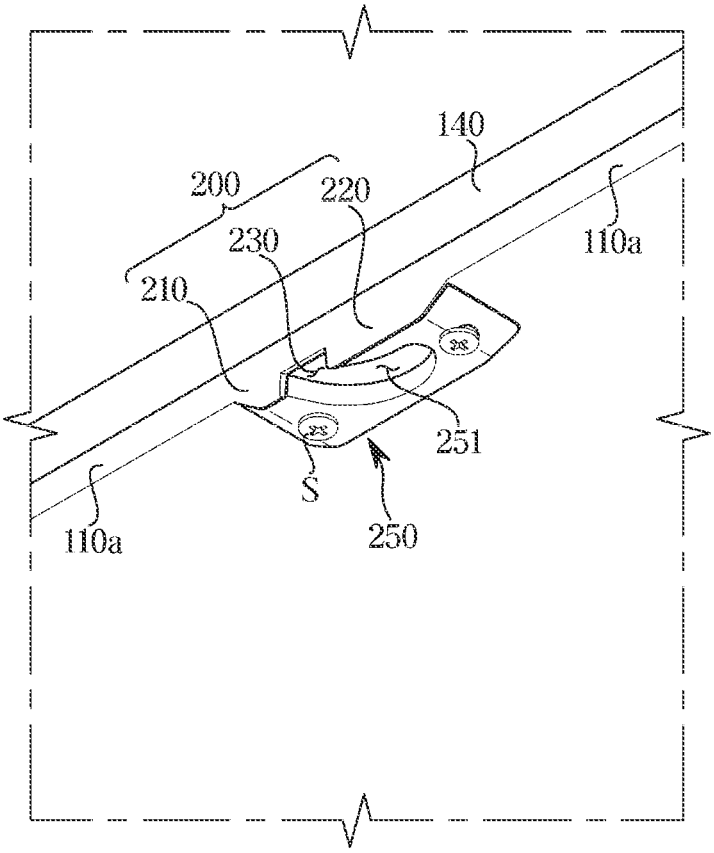
FIG. 8 is a view illustrating FIG. 7 when viewed from another angle.

FIG. 7 is an enlarged view of a part A of FIG. 1. FIG. 8 is a view illustrating FIG. 7 when viewed from another angle.

Referring to FIGS. 7 and 8, the rotation guide 250, which is provided to guide the rotating bar 35 to allow the rotating bar 35 to be rotated according to the opening and closing of the refrigerating compartment door 31 in which the rotating bar 35 is installed among the pair of refrigerating compartment doors 31, may be coupled to the first inner case 100*a*.

According to an embodiment, the first inner case 100*a* may be provided to cover a front member 253 of the rotation guide 250 (refer to FIG. 9) to prevent the rotation guide 250 from being exposed to the front of the first inner case 100*a*.

As mentioned above, the first inner case 100*a* may include the first upper plate 101, and the first upper plate 101 may include the upper plate flange 110*a* forming a part of the first flange members 110 and 110*a*.

The upper plate flange 110*a* may include a guide cover 200 having a shape corresponding to the front member 253 of the rotation guide 250 to prevent the rotation guide 250 from being exposed to the front of the upper plate flange 110*a*.

The guide cover 200 may be provided on one side of the upper plate flange 110*a*. Alternatively, the guide cover 200 may be provided in a center of the upper plate flange 110*a*.

Referring to FIGS. 7 and 8, the guide cover 200 may include a first protrusion 210 protruding downward from the upper plate flange 110*a*, a second protrusion 220 protruding downward from the upper plate flange 110*a* and laterally spaced apart from the first protrusion 210, and a guide opening 230 provided between the first protrusion 210 and the second protrusion 220.

The rotation guide 250 may include a guide groove 251 guiding the rotation of the rotating bar 35. A front end 251*a* of the guide groove 251 (refer to FIG. 9) and the guide opening 230 may be provided in a shape corresponding to each other to prevent the rotation guide 250 from being exposed to the front of the guide cover 200. With this structure, the guide groove 251 may be connected from the guide opening 230.

Conventionally, a front member of a rotation guide is arranged in a space formed by cutting off a portion of an upper plate flange. That is, the front member of the rotation guide is exposed in front of an inner case. Due to this structure, the upper plate flange is not smoothly connected, and thus a sense of unity in the inner case is low, and appearance quality of a refrigerator is deteriorated.

According to an embodiment, because the guide cover 200 covers the front member 253 of the rotation guide 250, the rotation guide 250 may not be exposed to the front of the first inner case 100*a*. In addition, because the upper plate flange 110*a* including the guide cover 200 is formed as a one-piece without a parting line, a sense of unity of the first inner case 100*a* may be improved. In addition, it is possible to improve appearance quality of the refrigerator.

Figure 9:
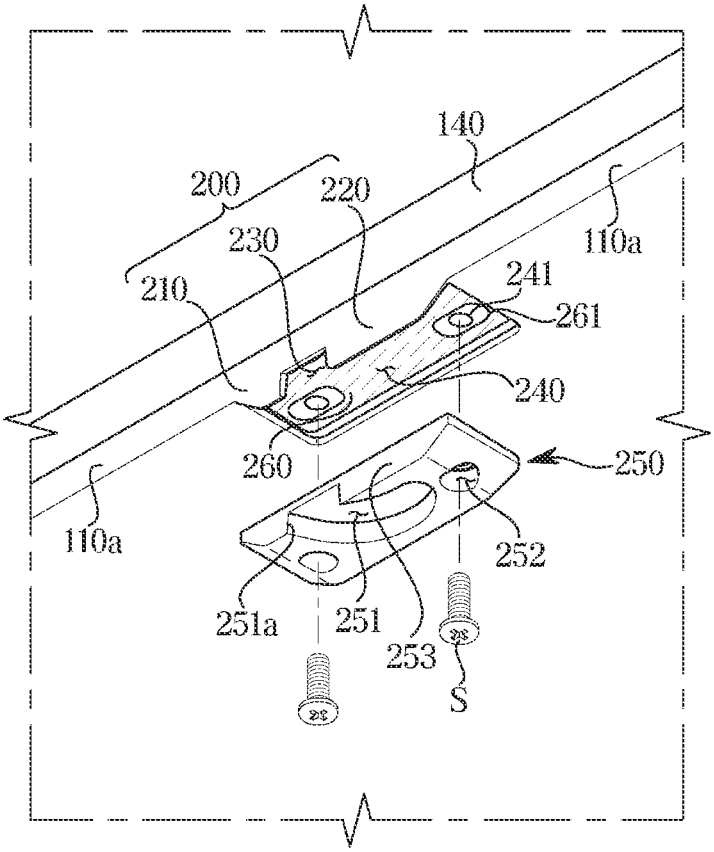
FIG. 9 is a view illustrating a state in which a rotation guide is disassembled from an inner case in the refrigerator according to an embodiment of the disclosure.

FIG. 9 is a view illustrating a state in which a rotation guide is disassembled from an inner case in the refrigerator according to an embodiment of the disclosure.

Referring FIG. 9, the rotation guide 250 may be coupled to the first upper plate 101 of the first inner case 100*a*. Particularly, the first upper plate 101 may include a guide mounting groove 240 provided to allow the rotation guide 250 to be inserted thereinto. The guide mounting groove 240 may be provided on a rear side of the guide cover 200. The guide mounting groove 240 may be provided in a shape corresponding to the rotation guide 250. In response to the rotation guide 250 being mounted to the guide mounting groove 240, a position of a second fastening hole 252 of the rotation guide 250 may correspond to a position of a first fastening hole 241 of the first upper plate 101.

The rotation guide 250 may be coupled to the first inner case 100*a* by a fastening member S. The first inner case 100*a* may include the first fastening hole 241 formed in the guide mounting groove 240. The rotation guide 250 may include the second fastening hole 252 penetrating the rotation guide 250.

A heat conduction plate 260 to be described later may include an opening 261 provided at a position corresponding to the first fastening hole 241 and formed to be larger than the first fastening hole 241.

As the fastening member S passes through the second fastening hole 252 and the opening 261 and is fastened to the first fastening hole 241, the fastening member S may couple the rotation guide 250 to the first upper plate 101.

As described above, in response to the coupling of the rotation guide 250 and the first upper plate 101, the front member 253 of the rotation guide 250 may be covered by the guide cover 200 so as not to be exposed to the front of the upper plate flange 110*a*.

Figure 10:
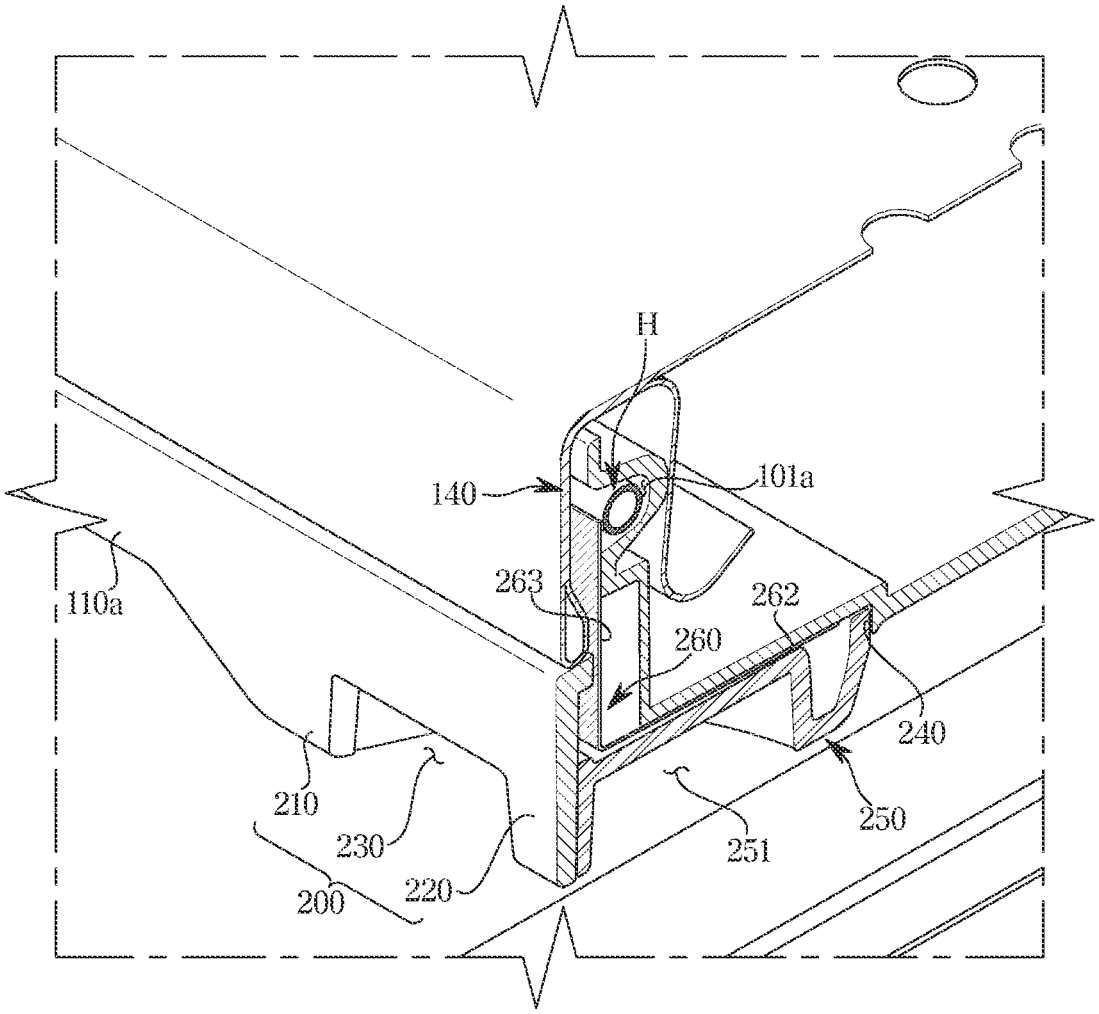
FIG. 10 is a cross-sectional perspective view taken along line B-B' of FIG. 7 in the refrigerator according to an embodiment of the disclosure.

FIG. 10 is a cross-sectional perspective view taken along line B-B' of FIG. 7 in the refrigerator according to an embodiment of the disclosure.

Referring to FIG. 10, the refrigerator according to an embodiment may include a heating pipe H provided along the front edge of the first inner case 100*a*. The heating pipe H may be arranged between the first inner case 100*a* and the outer case 140. The heating pipe H may be provided to generate heat. The heating pipe H may prevent dew from forming on the first flange members 110 and 110*a* by reducing a temperature difference between the first flange members 110 and 110*a* of the first inner casing 100*a* and the outside air.

The refrigerator according to an embodiment may include the heat conduction plate 260 provided to transfer heat from the heating pipe H to the rotation guide 250 by being in contact with the heating pipe H and the rotation guide 250.

Referring to FIG. 10, the first upper plate 101 may include a pipe receiving groove 101*a* arranged on the rear side of the guide cover 200 and provided to receive the heating pipe H. The heating pipe H may be inserted into the pipe receiving groove 101*a*. The pipe receiving groove 101*a* may be located above the guide mounting groove 240.

The heat conduction plate 260 may include a guide contact member 262 mounted to the guide mounting groove 240 and being in contact with the rotation guide 250, and an extension member 263 extending upward from one end of the guide contact member 262 toward the heating pipe H.

According to an embodiment, the heat conduction plate 260 may be provided in contact with the heating pipe H from the outside of the pipe receiving groove 101*a*. Particularly, at least a portion of the extension member 263 may be provided in contact with the heating pipe H from the outside of the pipe receiving groove 101*a*. In other words, at least a portion of the extension member 263 may be provided in contact with a front end of the heating pipe H.

The heat conduction plate 260 may be formed of a metal material having a high thermal conductivity. The heat conduction plate 260 may be in contact with the heating pipe H so as to receive heat from the heating pipe H, thereby transferring the heat to the rotation guide 250.

Figure 11:
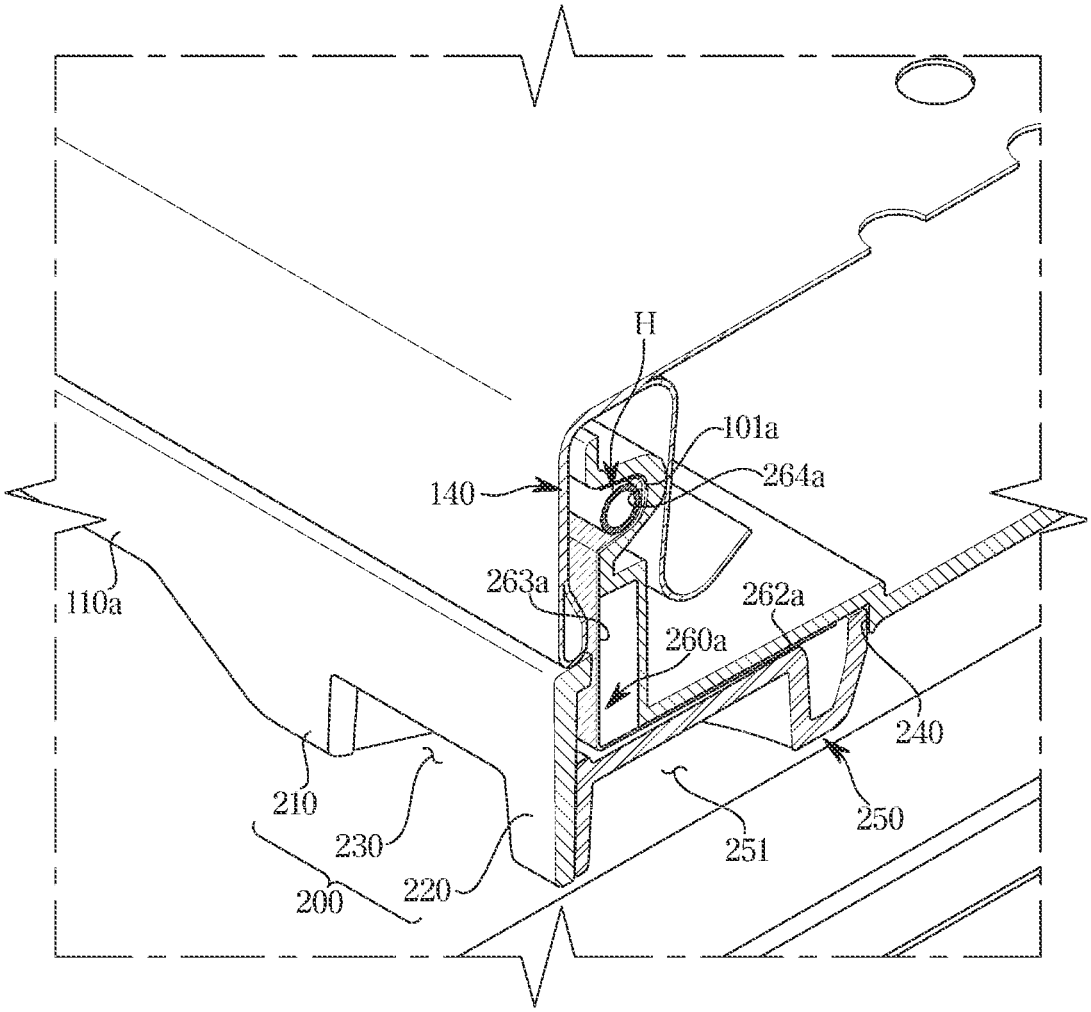
FIG. 11 is a cross-sectional perspective view illustrating a heat conduction plate including a pipe receiving member in the refrigerator according to an embodiment of the disclosure.

FIG. 11 is a cross-sectional perspective view illustrating a heat conduction plate including a pipe receiving member in the refrigerator according to an embodiment of the disclosure. Configurations other than a heat conduction plate 260*a* are the same as those of FIGS. 1 to 10, and thus the same descriptions will be omitted.

Referring to FIG. 11, the heat conduction plate 260*a* according to an embodiment may include a pipe receiving member 264*a*.

The pipe receiving member 264*a* may be inserted into a pipe receiving groove 101*a*. The pipe receiving member 264*a* may be provided in contact with a heating pipe H by receiving the heating pipe H.

According to an embodiment, the heat conduction plate 260*a* may include a guide contact member 262*a* mounted to a guide mounting groove 240, an extension member 263*a* extending upward from one end of the guide contact member 262*a*, and the pipe receiving member 264*a* provided at one end of the extension member 263*a*.

The heat conduction plate 260*a* may be in contact with the heating pipe H through the pipe receiving member 264*a*. Because the pipe receiving member 264*a* is inserted into the pipe receiving groove 101*a*, the heat conduction plate 260*a* may be in contact with the heating pipe H from the inside of the pipe receiving g groove 101*a*. In addition, the pipe receiving member 264*a* may be in contact with the heating pipe H at a plurality of points. Because the pipe receiving member 264*a* is in contact with the heating pipe H at a plurality of points, the heat conduction plate 260*a* may receive heat from the heating pipe H more effectively. Accordingly, a heat transfer efficiency of the heat conduction plate 260*a* from the heating pipe H to the rotation guide 250 may be improved.

As is apparent from the above description, a refrigerator may improve appearance quality thereof by preventing a rotation guide from being exposed to a front of an inner case.

Further, a refrigerator may improve appearance quality thereof by including a flange member, without a parting line, of an inner case.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an inner case forming a storage compartment, and including a flange member forming a front edge of the inner case;

an outer case coupleable to an outside of the inner case to form an exterior of the refrigerator;

an insulating material arranged between the inner case and the outer case while the outer case is coupled to the inner case;

a first door rotatably coupleable to the outer case to open and close at least a portion of the storage compartment;

a second door at a side of the first door and rotatably coupleable to the outer case to open and close at least another portion of the storage compartment;

a rotating bar configured to be rotated with respect to the first door or the second door so that the rotating bar covers a gap between the first door and the second door while the first door and the second door are closed; and a rotation guide coupleable to the inner case to guide the rotating bar while the rotating bar is being rotated according to opening and closing of the first door or opening and closing of the second door, wherein the inner case includes:

a guide cover provided on the flange member and configured to cover a front member of the rotation guide so that the front member of the rotation guide is unexposed to a front side of the inner case, and a guide mounting groove provided as a recessed portion of the inner case at a rear side of the guide cover so that the rotation guide is insertable into the guide mounting groove.

2. The refrigerator of claim 1, wherein the inner case comprises a flange member forming a front edge of the inner case, wherein the flange member comprises a guide cover having a shape corresponding to a shape of the front member of the rotation guide so that the front member of the rotation guide is unexposed to a front side of the flange member of the inner case.

3. The refrigerator of claim 2, wherein the inner case comprises an upper plate, a lower plate, a left plate, a right plate, and a rear plate which are formed by injection molding.

4. The refrigerator of claim 3, wherein the upper plate comprises an upper plate flange forming at least a portion of the flange member, wherein the guide cover is provided on the upper plate flange.

5. The refrigerator of claim 4, wherein the upper plate flange is formed as a one-piece without a parting line.

6. The refrigerator of claim 4, wherein the guide cover comprises:

a first protrusion formed to protrude downward from the upper plate flange;

a second protrusion formed to protrude downward from the upper plate flange, the second protrusion being laterally spaced apart from the first protrusion; and a guide opening between the first protrusion and the second protrusion.

7. The refrigerator of claim 6, wherein the rotation guide comprises a guide groove to guide a rotation of the rotating bar, wherein a front end of the guide groove and the guide opening are provided in a shape corresponding to each other.

8. The refrigerator of claim 3, further comprising a heating pipe between the inner case and the outer case and along the front edge of the inner case; and a heat conduction plate to transfer heat from the heating pipe to the rotation guide while the heat conduction plate is in contact with the heating pipe and the rotation guide.

9. The refrigerator of claim 8, wherein the upper plate comprises a pipe receiving groove at the rear side of the guide cover to receive the heating pipe.

10. The refrigerator of claim 9, wherein the heat conduction plate is provided to be in contact with the heating pipe from an outside of the pipe receiving groove.

11. The refrigerator of claim 9, wherein the heat conduction plate comprises a pipe receiving member insertable into the pipe receiving groove to receive the heating pipe and be in contact with heating pipe.

12. The refrigerator of claim 9, wherein the upper plate comprises the guide mounting groove, and the guide mounting groove is provided under the pipe receiving groove.

13. The refrigerator of claim 12, wherein the heat conduction plate comprises:

a guide contact member mountable to the guide mounting groove; and an extension member formed to extend upwardly from one end of the guide contact member toward the heating pipe.

14. The refrigerator of claim 12, wherein the guide mounting groove comprises a first fastening hole; and the rotation guide comprises a second fastening hole corresponding to the first fastening hole, wherein the heat conduction plate comprises an opening provided to correspond to the first fastening hole and formed to be larger than the first fastening hole.

15. The refrigerator of claim 14, wherein the rotation guide is coupleable to the guide mounting groove using a fastening member which passes through the second fastening hole and the opening of the heat conduction plate to be fastened to the first fastening hole.

* * * * *